United States Patent [19]

Norimatsu et al.

[11] 4,176,626

[45] Dec. 4, 1979

[54] AIR-FUEL RATIO FEEDBACK CONTROL SYSTEM

[75] Inventors: Hideaki Norimatsu; Yoshiaki Sato, both of Kariya, Japan

[73] Assignee: Nippondenso Co., Ltd., Kariya, Japan

[21] Appl. No.: 812,560

[22] Filed: Jul. 5, 1977

[30] Foreign Application Priority Data

Jul. 3, 1976 [JP] Japan ..... 51-79152

[51] Int. Cl.[2] ..... F02B 3/08; F02M 7/12; F01N 3/08

[52] U.S. Cl. ..... 123/32 EE; 123/119 EC; 60/276; 60/285

[58] Field of Search ..... 123/32 EE, 119 EC, 97 B, 123/32 EA; 261/DIG. 74; 60/276, 285

[56] References Cited

U.S. PATENT DOCUMENTS 3,990,411 11/1976 Oberstadt et al. ..... 60/276

*Primary Examiner*—Charles J. Myhre
*Assistant Examiner*—P. S. Lall
*Attorney, Agent, or Firm*—Edwin E. Greigg

[57] ABSTRACT

The combination of a fuel supply system, an exhaust gas oxygen concentration sensor, a feedback control circuit connected to the fuel supply system and to the exhaust gas oxygen concentration sensor, a disabling circuit connected to the feedback control circuit and a fuel increment signal generating circuit connected to the fuel supply system and the disabling circuit. The combination controls the air-fuel mixture to be supplied to the engine. The combination is speed sensitive, i.e., when a predetermined engine speed is exceeded, the disabling circuit disconnects the feedback control circuit from the fuel supply system and the fuel increment signal generating circuit generates a signal which is applied to the fuel supply system in order to increase the fuel quantity supplied by the fuel supply system.

5 Claims, 3 Drawing Figures

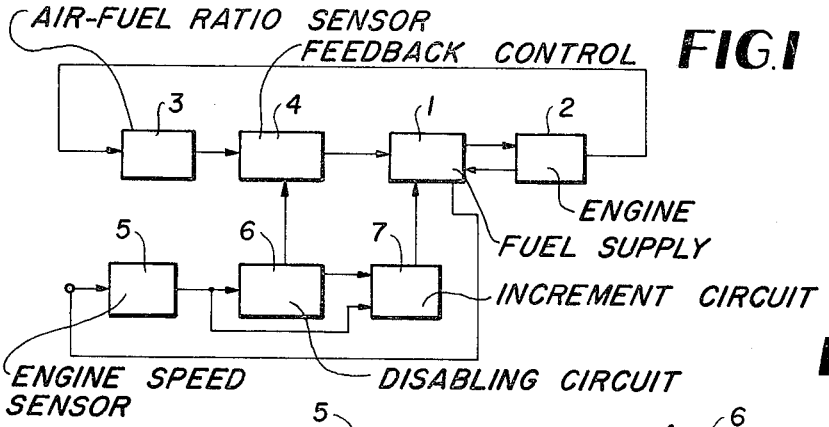
FIG.1
FIG.2
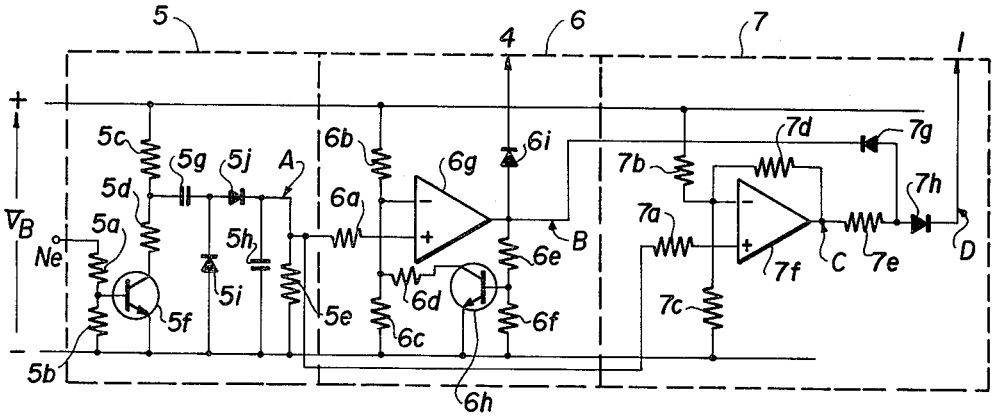
FIG.3
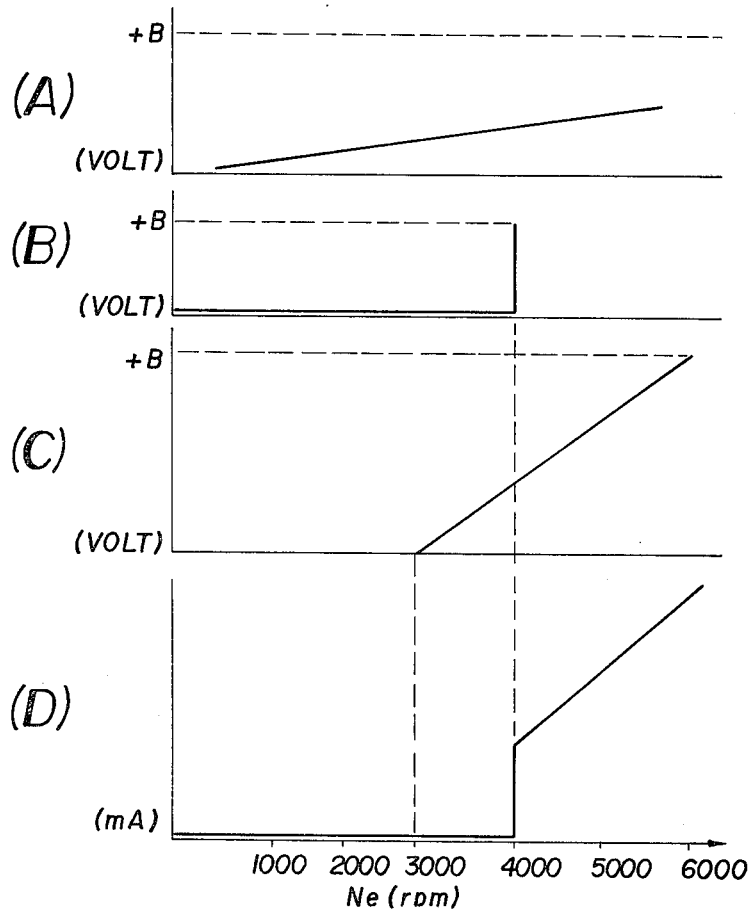

AIR-FUEL RATIO FEEDBACK CONTROL SYSTEM

This application discloses subject matter disclosed and claimed in application Ser. No., 812,955, filed July 5, 1977. Specifically, the common subject matter relates to the feedback control circuit 4. Both applications are assigned to a common assignee.

BACKGROUND OF THE INVENTION

This invention relates to an air-fuel ratio feedback control system for controlling the air-fuel ratio of an air-fuel mixture to be supplied to an internal combustion engine by sensing and feeding back the oxygen concentration of engine exhaust gases which is representative of the air-fuel ratio of the supplied air-fuel mixture.

In order to purify exhaust gases from an internal combustion engine, it has heretofore been proposed to sense and feed back the oxygen concentration of exhaust gases in order to control the air-fuel ratio of an air-fuel mixture in accordance with the sensed value so that the ratio is equal to, for example, a constant theoretical air-fuel ratio. This method of feedback control has proved to be advantageous in that the air-fuel ratio remains constant even though major changes occur in outside environments such as atmospheric pressure variations, intake air temperature changes and so forth. Further, it has been verified that with the integration of the sensed air-fuel ratio value prior to feeding back improved control speed can be attained. However, if this feedback control is kept operative during all operating conditions of an internal combustion engine, a problem arises that desired power demands are not met at high engine speeds because the air-fuel ratio is held at a constant level. In addition, it has been proposed to enrich the air-fuel mixture by disabling the feedback control system at high loads in order to prevent abnormal increase in the reaction temperature due to the use of catalysts for purifying exhaust gases. However, from a fuel economy standpoint, it would not be advantageous to supply a rich mixture of a constant ratio while the feedback loop is disabled.

OBJECT OF THE INVENTION

It is with the above in view that the present invention came about, and its object is to keep the feedback control ineffective and to vary the richness of air-fuel mixture in accordance with the engine speed when a great engine speed is sensed, in order to minimize the increase of richness of the mixture thereby improving the fuel economy at intermediate and high engine speeds.

BRIEF DESCRIPTION OF THE INVENTION

FIG. 1 is a block diagram of a preferred embodiment of the invention;

FIG. 2 is a circuit diagram of the portion of the feedback control system embodying the invention; and FIG. 3 (A)-(D) illustrate diagrams useful in explaining the operation of the feedback control system, showing the relationships between engine speed and voltage and current signals appearing at various points of the circuitry of FIG. 2.

DESCRIPTION OF THE PREFERRED EMBODIMENT

The invention will be described below with regard to an embodiment thereof in conjunction with the accompanying drawings.

Referring to FIG. 1 which shows an overall system construction an air-fuel mixture supplying device 1 comprises means for supplying an air-fuel mixture to the intake portion of an internal combustion engine 2, which is an electronically controlled fuel injection system in which the air-fuel ratio characteristics have been preset according to engine operating conditions. An air-fuel ratio sensor 3 is located at the exhaust portion of the engine, which is of a known type capable of providing a signal having a step characteristic based on the oxygen concentration of the exhaust gases. A feedback system for feeding back a measurement signal from the air-fuel ratio sensor 3 at the exhaust portion to the intake portion of the engine 2 includes a feedback control circuit 4 which comprises a discrimination circuit for comparing the measurement signal to a predetermined target value and an integration circuit for integrating the discriminated signal from the discrimination circuit to produce an integration signal, an engine speed sensor 5 for sensing the rotational speed of the engine 2, a feedback control disabling circuit 6 for comparing the sensed engine speed from the engine speed sensor 5 with a predetermined value and for making ineffective the feedback control provided by the feedback control circuit 4 when the sensed engine speed exceeds a predetermined value, and a fuel increment signal generating circuit 7 for amplifying the sensed engine speed from the engine speed sensor 5 and for applying the amplified engine speed signal to the air-fuel mixture supplying device 1 when the feedback control disabling circuit 6 starts to produce a feedback disabling signal so that the amount of fuel will be incremented according to the engine speed from the value determined by the preset air-fuel ratio characteristics. The integrated signal from the integration circuit in the feedback control circuit 4 is supplied to the air-fuel mixture supplying device 1 to provide correction for the air-fuel ratio based on the integrated value. As a means for accomplishing such correction, it is known in the art to increase the amount of air or fuel in accordance with the integral.

Referring to FIG. 2, the engine speed sensor 5, the feedback control disabling circuit 6 and the fuel increment signal generating circuit 7 of the above-described feedback system are shown in detail. The engine speed sensor 5 comprises resistors *5a*, *5b*, *5c*, *5d* and *5e*, a transistor *5f*, capacitors *5g*, *5h*, and diodes *5i* and *5j*. Applied at a terminal Ne is a pulse signal derived from the air-fuel mixture supplying circuit 1, which signal has a magnitude responsive to the engine speed. An analog voltage signal proportional to the number of pulses appears at point A.

The feedback control disabling circuit 6 comprises resistors *6a*, *6b*, *6c*, *6d*, *6e*, *6f*, a comparator *6g*, and an NPN transistor *6h*, and a diode *6i*. A voltage divider consisting of the resistors *6b* and *6c* is set to provide a reference level for comparison with engine speed. The resistors *6c* and *6d* are connected to the collector-emitter segment of the transistor *6h*. The base of the transistor *6h* is controlled by the output B of the comparator *6g* via a resistor *6e*, and is connected to the negative supply line via the resistor *6f*. By means of this circuit, the comparator *6g* acquires the mode of operation of a threshold circuit which, at point A, compares the output voltage of the engine speed sensor 5, which is proportional to engine rpm, with the voltage determined by means of the resistors *6b* and *6c*.

As long as the input analog voltage at the non-inverting input to the comparator *6g* exceeds the reference voltage determined by the voltage divider *6b, 6c,* the comparator output is positive. Subsequently the base of the transistor *6h* receives a positive voltage determined by the voltage divider *6e, 6f,* whereupon the transistor *6h* becomes conductive and switches the resistor *6d* parallel to the resistor *6c.* By this means the reference voltage at the inverting input of the comparator *6g* is lowered and the difference between the reference voltage and the input voltage at the non-inverting input is increased. This further increases the output voltage of the comparator *6g* up to saturation. This then is achieved, by coupling with the transistor *6h* in the manner, as noted above, of a threshold circuit. When the analog input signal proportional to engine speed exceeds the reference level, a voltage $+V_B$ will appear at point B. This will cause a signal to be applied to the feedback control circuit 4, making the feedback control ineffective. It is to be noted that in order to disable the feedback control the integral from the integrator circuit of the feedback control circuit 4 is held at a constant value as by short circuiting an integrating capacitor connected between the input and output of an operational amplifier through use of a transistor or other suitable means so as to disable the integrating function.

The fuel increment signal generating circuit 7 comprises resistors *7a, 7b, 7c, 7d, 7e,* an operational amplifier *7f,* and diodes *7g, 7h.* The differential amplifier *7f,* when a predetermined engine speed has been reached, provides an output signal, at point C, proportional to the engine speed. The predetermined engine speed is set by properly selecting the resistance values of resistors *7b, 7c.* The air-fuel mixture supplying device 1 responds to the signal from the fuel imcrement signal generating circuit 7 by increasing the air-fuel ratio of an air-fuel mixture to be supplied to the engine from the values determined by the preset air-to-fuel ratio characteristics. Fuel incrementation is accomplished in an electronically controlled fuel injection system by increasing the time during which fuel is injected in accordance with the preset air-to-fuel ratio characteristics.

The operation of this arrangement will be described with reference to FIG. 3 which shows how the voltage and current signals at points A, B, C and D change with the engine speed Ne (rpm) of the engine. Let it be assumed that the engine experiences a high load operation when the engine speed exceeds approximately 4000 rpm. Since the feedback control disabling circuit 6 is required to disable the feedback control at 4000 rpm, the values of resistors *6b* and *6c* are selected to provide a reference value equal to the voltage appearing at that engine speed. The value of resistors *7b* and *7c* of the fuel increment signal generating circuit 7 are selected to provide a somewhat lower engine speed than 4000 rpm, for example, 3000 rpm.

When the engine speed is below the reference value set by the feedback control disabling circuit 6, the voltage appearing at B is kept at a low level, so that the output of the operational amplifier *7f* is grounded. In this condition, the feedback control disabling circuit 6 does not apply the disabling signal to the feedback control circuit 4. The air-fuel mixture supplying device 1 does not receive the fuel increment signal from the fuel increment signal generating circuit 7. Accordingly, when even a slight deviation occurs of the air-fuel ratio from the theoretical characteristics, this deviation is detected by the air-fuel ratio sensor 3, causing an increase or decrease of the amount of fuel corresponding to the deviation by the air-fuel mixture supplying device 1.

When the engine speed exceeds the predetermined value, i.e. 4000 rpm, the output, at B, of the comparator circuit *6g* of the feedback control disabling circuit 6 rises to a high level, disabling the feedback control circuit 4 so that the air-fuel mixture supplying device 1 supplies an air-fuel mixture in accordance with the preset, basic air-fuel ratio characteristics. Simultaneously therewith, the current signal from the fuel increment signal generating circuit 7 is supplied through the diode *7h* to the air-fuel mixture supplying device 1. Since the current signal increases in proportion to the engine speed, the air-fuel mixture supplying device 1 increases the richness of the air-fuel mixture from the basic air-fuel ratio characteristics by the amount proportional to the current signal. In particular, at 3000 rpm the differential amplifier *7f* generates an output voltage at point C proportional to the rpm. At 4000 rpm, with an output voltage at B, the current which previously flowed via the diode *7g* to the negative supply line, now flows via the diode *7h* to the air-fuel mixture supplying device 1. The diode *7g* thus assumes the function of a gate circuit.

It should be noted that the preselected engine speed 4000 rpm above which the feedback control loop is made ineffective as well as 3000 rpm at which the fuel increment signal starts being generated may be selected at different values depending upon the engine operating characteristics.

As has been described above, the present invention has the advantages that since, upon reaching a predetermined engine speed, the feedback control loop is disabled and a compensatory signal is supplied to the air-fuel mixture supplying device to vary the richness of the air-fuel mixture in accordance with the engine speed, it is possible to prevent damages to exhaust gas purifying catalytic converters which would otherwise sustain serious damage due to melting, to meet high power demands at high engine speeds, and to enhance fuel economy at intermediate and high engine speeds by reducing the rate at which the fuel richness is increased.

It should be noted that the air-fuel mixture supplying means 1 may be the electronically controlled fuel injection system as for example shown in U.S. Pat. No. 3,745,768, especially in FIGS. 2 and 4 thereof. In order to sense the rotational speed of the engine by the speed sensor 5, the terminal $N_e$ thereof may be connected to a junction between a capacitor 312 and a diode 309 in FIG. 4 of the above U.S. Patent.

We claim:

1. In combination with a fuel supply system for an internal combustion engine, said fuel supply system controlling the amount of air-fuel mixture to be supplied to an engine in accordance with preset air-fuel ratio characteristics of the fuel supply system, and an air-fuel ratio sensing means for sensing the oxygen concentration of the exhaust gas of an engine and generating an output signal corresponding to the air-fuel ratio of the air-fuel mixture supplied by the fuel supply system, the improvement comprising:

(a) a feedback control circuit connected to the fuel supply system and to the air-fuel ratio sensing means, said feedback control circuit including means for integrating the output signal of the air-fuel ratio sensing means and applying an integrated signal to the fuel supply system;

(b) a disabling circuit connected to the feedback control circuit for disconnecting the feedback control circuit from the fuel supply system when engine speed is above a predetermined value; and (c) a fuel increment signal generating circuit connected to the fuel supply system and the disabling circuit for generating and applying a compensating signal to the fuel supply system corresponding to engine speed in order to increase the fuel quantity supplied by the fuel supply system when the feedback control circuit is disconnected from the fuel supply system.

2. The combination as defined in claim 1, wherein the improvement further comprises:

(d) engine speed sensor means connected to the fuel supply system, the disabling circuit and the fuel increment signal generating circuit, for generating a signal derived from the fuel supply which has a magnitude responsive to engine speed.

3. The combination as defined in claim 2, wherein the disabling circuit includes means setting a reference level for engine speed and a comparator connected at its input to the engine speed sensor and to the reference level setting means, and at its output to the feedback control circuit and the fuel increment signal generating circuit, said comparator producing a signal at its output when the signal from the engine speed sensor exceeds the set reference level.

4. The combination as defined in claim 2, wherein the fuel increment signal generating circuit includes means setting a reference level for engine speed and a comparator connected at its input to the engine speed sensor and to the reference level setting means, and at its output to the disabling circuit and the fuel supply system, said comparator producing a signal at its output when the signal from the engine speed sensor exceeds the set reference level.

5. The combination as defined in claim 2, wherein:

(i) the disabling circuit includes means setting a reference level for engine speed and a comparator connected at its input to the engine speed sensor and to the reference level setting means, and at its output to the feedback control circuit and the fuel increment signal generating circuit, said comparator producing a signal at its output when the signal from the engine speed sensor exceeds the reference level; and (ii) the fuel increment signal generating circuit includes means setting a reference level for engine speed and a comparator connected at its input to the engine speed sensor and to the reference level setting means, and at its output to the comparator of the disabling circuit and the fuel supply system, said fuel increment signal generating circuit comparator producing an output when the signal from the engine speed sensor exceeds the set reference level, said output being applied to the fuel supply system when the disabling circuit comparator produces a signal at its output.

* * * * *